US007009574B2

(12) United States Patent
Naito et al.

(10) Patent No.: US 7,009,574 B2
(45) Date of Patent: Mar. 7, 2006

(54) PLURAL-REFLECTOR ANTENNA SYSTEM

(75) Inventors: Izuru Naito, Tokyo (JP); Kenji Kusakabe, Tokyo (JP); Toshiyuki Horie, Tokyo (JP); Syuji Nuimura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/916,470

(22) Filed: Aug. 12, 2004

(65) Prior Publication Data

US 2005/0200547 A1 Sep. 15, 2005

(30) Foreign Application Priority Data

Mar. 10, 2004 (JP) ..... 2004-067166

(51) Int. Cl.
*H01Q 13/00* (2006.01)

(52) U.S. Cl. ..... 343/781 P; 343/781 CA

(58) Field of Classification Search ..... 343/781 CA, 343/781 P

See application file for complete search history.

(56) References Cited

U.S. PATENT DOCUMENTS 3,696,436 A * 10/1972 Yokoi et al. ..... 343/782
3,927,408 A * 12/1975 Schmidt ..... 343/779
4,031,538 A * 6/1977 Lundgren, Jr. ..... 343/781 CA
4,034,378 A * 7/1977 Ohm ..... 343/781 CA
5,790,077 A * 8/1998 Luh et al. ..... 343/781 P
6,320,553 B1 * 11/2001 Ergene ..... 343/781 P

FOREIGN PATENT DOCUMENTS

JP 2002-135042 5/2002

* cited by examiner

*Primary Examiner*—Tho Phan
(74) *Attorney, Agent, or Firm*—Oblon, Spivak, McClelland, Maier & Neustadt, P.C.

(57) ABSTRACT

In order to lessen the deterioration of the VSWR, a plural-reflector antenna system is provided wherein an appropriately shaped vertex matching plate is disposed on the subreflector and electric waves that reenter the primary radiator are cancelled out.

The electric waves radiated from the primary radiator are reflected by the subreflector and are radiated into space after being reflected by the main reflector. The passing area in the horn aperture, through which the reflected waves from the vertex matching plate pass, is made to be analogous to the aperture of the primary radiator, by defining the vertex matching plate as an ellipsoid, and by orienting its minor-axis direction in the major-axis direction of the main reflector and its major-axis direction, in the minor-axis direction of the main reflector.

7 Claims, 4 Drawing Sheets

MAIN-REFLECTOR CROSS SECTIONAL VIEW ALONG THE MAJOR AXIS

MAIN-REFLECTOR CROSS SECTIONAL VIEW ALONG THE MINOR AXIS

MAIN-REFLECTOR CROSS SECTIONAL VIEW ALONG THE MAJOR AXIS

MAIN-REFLECTOR CROSS SECTIONAL VIEW ALONG THE MINOR AXIS

PLURAL-REFLECTOR ANTENNA SYSTEM

BACKGROUND OF THE INVENTION

1. Field of the Invention

The present invention relates to plural-reflector antenna systems including a main reflector, a subreflector, and a primary radiator.

2. Description of the Related Art

Japanese Laid-Open Patent Publication 2002-135042 discloses technology for lessening the deterioration of VSWR in the central vicinity of a subreflector in an antenna system. According to Japanese Laid-Open Patent Publication 2002-135042, conventional antenna systems are constituted of two reflectors, i.e., a paraboloidal main reflector and a hyperboloidal subreflector, a primary radiator, and a vertex matching section that is disposed in the central vicinity of the subreflector and is constituted from a circular-plate with a convex or concave contour. Electric waves radiated from the primary radiator are radiated into space after being reflected by the subreflector and the main reflector. In this situation, in cases where no vertex matching section is provided, electric waves radiated from the primary radiator to the central vicinity of the subreflector are directly reflected by the subreflector to the primary radiator, and the reflected electric waves deteriorate the VSWR of the primary radiator. The vertex matching section has a protruded or recessed contour, and is disposed in the central vicinity of the subreflector, in such a manner that electric waves that reenter the primary radiator after being reflected by the vertex matching section have phases opposite to those of other waves that come from the region outside the vertex matching section and reenter the primary radiator. As a result, electric waves that reenter the primary radiator are nearly cancelled out on the whole by disposing the vertex matching section; therefore, the deterioration of the VSWR is lessened.

DISCLOSURE OF INVENTION

Recently, antenna systems have been developed, which are mounted on mobile bodies such as aircraft, train cars, for the communication with communication satellites; these antenna systems are often mounted on canopies where there are no visual obstructions to the communication satellites; therefore, profile-lowering (meaning that the standing height is low) mainly for reducing aero resistance is demanded. In order to meet this requirement, antenna systems with an ellipsoidal main reflector have been employed. In the antenna system disclosed in Japanese Laid-Open Patent Publication 2002-135042, the vertex matching section is disposed in such a manner that the electric waves, which come from the subreflector and reenter the primary radiator, are cancelled out; however, because the vertex matching section disclosed in Japanese Laid-Open Patent Publication 2002-135042 has a circular reflecting surface, when used in an antenna system having with the ellipsoidal main reflector as described above, it has not been possible to make reentering waves that come from the region outside the vertex matching section and enter the primary radiator, and reentering waves from the vertex matching section, effectively cancel out each other, on the whole; therefore, there has been a problem in that the deterioration of the VSWR cannot sufficiently be lessened. In addition, also in cases where a pyramidal horn having a rectangular cross section is utilized as a primary radiator of an antenna system that has an axisymmetric main reflector, the circular vertex matching section has not been able to make the reentering waves, which come from the region outside the vertex matching section and enter the primary radiator, and the reentering waves from the vertex matching section, effectively cancel out each other, on the whole; therefore, there has been a problem in that the deterioration of the VSWR cannot sufficiently be lessened.

SUMMARY OF THE INVENTION

The present invention has been implemented in order to solve problems discussed above; with respect to a plural-reflector antenna system, it is an object of the present invention to obtain an antenna system that lessens the deterioration of the VSWR, by disposing an appropriately shaped vertex matching plate on the subreflector, and by canceling out electric waves that reenter the primary radiator.

A plural-reflector antenna system according to claim 1 of the present invention includes an ellipsoidal main reflector; a subreflector being disposed opposite to the main reflector; a primary radiator for radiating electric waves to the subreflector, the primary radiator being disposed opposite to the subreflector; and a vertex matching plate for reflecting to the primary radiator the electric waves radiated from the primary radiator, the vertex matching plate being disposed in the approximately central position of the subreflector and having an ellipsoidal mirror surface.

A plural-reflector antenna system according to claim 2 of the present invention is provided wherein, in the plural-reflector antenna system according to claim 1, the minor-axis direction of the ellipsoid of the vertex matching plate is oriented in the major-axis direction of the ellipsoid of the main reflector.

A plural-reflector antenna system according to claim 3 of the present invention is provided wherein, in the plural-reflector antenna system according to claim 1, the rim of the vertex matching plate is formed in skirt shape.

A plural-reflector antenna system according to claim 4 or 5 of the present invention is provided wherein, in the plural-reflector antenna system according to claim 1, the primary radiator has a pyramidal horn or an ellipsoidal horn.

A plural-reflector antenna system according to claim 6 or 7 of the present invention includes an axisymmetrically-shaped main reflector; a subreflector being disposed opposite to the main reflector; a primary radiator for radiating electric waves to the subreflector, the primary radiator being disposed opposite to the subreflector and having a pyramidal horn or an ellipsoidal horn; and a vertex matching plate for reflecting to the primary radiator the electric waves radiated from the primary radiator, the vertex matching plate being disposed in the approximately central position of the subreflector and having an ellipsoidal mirror surface.

According to the invention described in claim 1 or 2, in a plural-reflector antenna system including an ellipsoidal main reflector, a vertex matching plate with an ellipsoidal reflection surface is disposed in the approximately central position of the subreflector; therefore, the deterioration of the VSWR due to electric waves reentering the primary radiator can be suppressed.

According to the invention described in claim 3, because the rim of the vertex matching plate is formed in skirt shape, the deterioration of the VSWR can be suppressed by suppressing the scattering of electric waves on the rim of the vertex matching plate.

According to the invention described in claim 4 or 5, the primary radiator has a pyramidal horn or an ellipsoidal horn;

a vertex matching plate with an ellipsoidal reflection surface is disposed in the approximately central position of the subreflector; therefore, the passing area in the aperture of the primary radiator, through which the reflected waves from the vertex matching plate pass, can be made to have a shape that is analogous to the aperture shape of the primary radiator. As a result, the deterioration of the VSWR due to the electric waves reentering the primary radiator can be suppressed.

In a plural-reflector antenna system including an axisymmetrically-shaped main reflector, and a primary radiator having a pyramidal horn or an ellipsoidal horn, a vertex matching plate with an ellipsoidal reflection surface is disposed in the approximately central position of the subreflector; therefore, the passing area in the aperture of the primary radiator, through which the reflected waves from the vertex matching plate pass, can be made to have a shape that is analogous to the aperture shape of the primary radiator. As a result, the deterioration of the VSWR due to the electric waves reentering the primary radiator can be suppressed.

BRIEF DESCRIPTION OF THE DRAWINS

DETAILED DESCRIPTION OF THE PREFERRED EMBODIMENTS

Embodiment 1

A plural-reflector antenna system according to Embodiment 1 of the present invention will be discussed referring to FIGS. 1 and 2.

Figure 1:
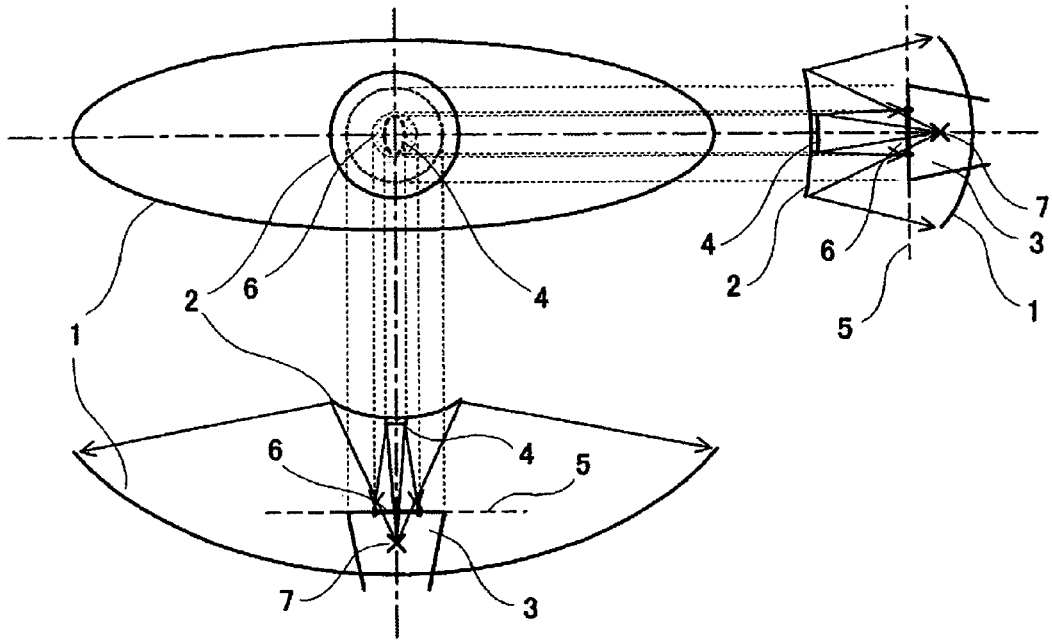
FIG. 1 is a view illustrating a configuration of a plural-reflector antenna system according to Embodiment 1 of the present invention.
Figure 2:
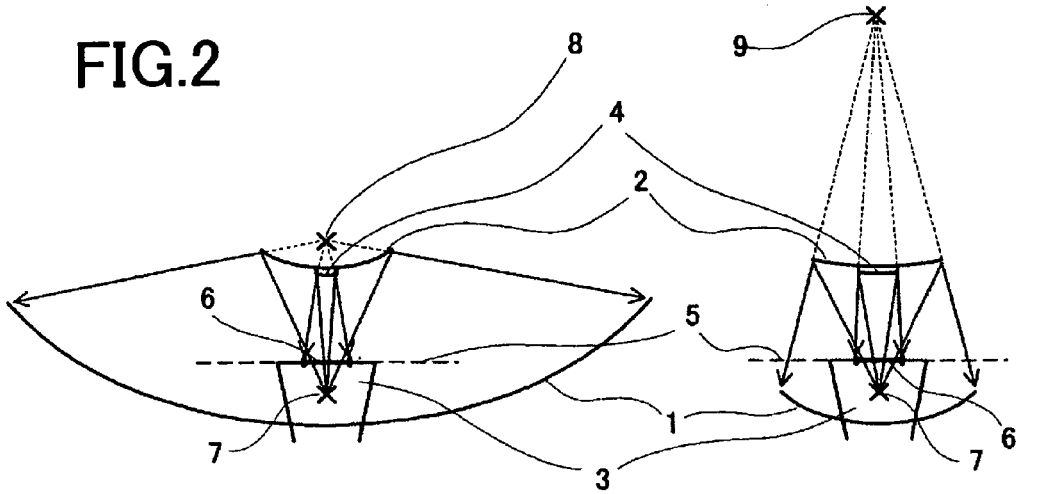
FIG. 2 is a cross-sectional view of a plural-reflector antenna system according to Embodiment 1 of the present invention.

FIG. 1 is a view illustrating a configuration of a plural-reflector antenna system according to Embodiment 1 of the present invention. In FIG. 1, at 1 is a main reflector; at 2 is a subreflector disposed opposite to the main reflector; at 3 is a primary radiator disposed opposite to the subreflector 2. The main reflector 1 has an elliptical perimeter, and its mirror-surface contour is concave and aspheric (e.g., paraboloidal or modified-paraboloidal mirror surface). The subreflector 2 has an approximately circular perimeter, and its mirror-surface contour is convex and aspheric (e.g., a hyperboloidal or modified-hyperboloidal mirror surface). The primary radiator 3 is a conical horn-radiator. The plural-reflector antenna system has the configuration of a Cassegrain antenna and is constituted in such a manner that electric waves radiated from the primary radiator 3 are reflected by the subreflector 2, and then are radiated into space after being reflected by the main reflector 1. At 4 is an ellipsoidal vertex matching plate, which is, in the approximately central position of the subreflector 2, disposed opposite to the primary radiator 3, has an ellipsoidal mirror surface opposite to the primary radiator 3 and reflects to the primary radiator 3 the electric waves radiated from the primary radiator 3. At 5 is an aperture plane including the horn aperture of the primary radiator 3; at 6 is a passing area in the aperture plane 5 through which the reflected waves from the vertex matching plate 4 pass; and at 7 is the phase center of the primary radiator 3.

Next, the operation of the plural-reflector according to Embodiment 1 will be discussed referring to FIG. 2. FIG. 2 is a cross-sectional view of the plural-reflector antenna system according to Embodiment 1. In FIG. 2, at 8 is a focal point of the subreflector 2, in the cross section along the major axis of the main reflector 1; and at 9 is a focal point of the subreflector 2, in the cross section along the minor axis of the main reflector 1. In FIG. 2, components and parts indicated with the same reference marks as those in FIG. 1 are identical to the components and parts in FIG. 1.

Electric waves radiated from the primary radiator 3, which behave nearly the same way in geometrical optics as light rays originating in the phase center 7 do, proceed in the same direction as the light rays originating in the focal point of the subreflector 2 do, after being reflected by the subreflector 2. In this situation, the electric wave that has entered the rim (the peripheral portion) of the subreflector 2 proceeds to the rim (the peripheral portion of the ellipsoidal reflection surface) of the main reflector 1. The mirror surfaces of the main reflector 1 and the subreflector 2 are modified in such a manner that the aperture of the main reflector 1 is ellipsoidal; therefore, as illustrated in FIG. 2, the focal point 8 of the subreflector 2 in the cross section along the major axis of the main reflector 1 is closer to the subreflector 2 than the focal point 9 of the subreflector 2 in the cross section along the minor axis of the main reflector 1 is. Accordingly, the passing area 6 in the horn aperture, through which the reflected waves from the vertex matching plate 4 pass, can be made a nearly circular area that is analogous to the aperture of the primary radiator 3, by defining the vertex matching plate 4 as an ellipsoid, and by orienting its minor-axis direction in the major-axis direction of the main reflector 1, and its major-axis direction in the minor-axis direction of the main reflector 1. In other words, this may be also understood in this way: the proportion, in cross section along the minor-axis direction of the main reflector 1, of waves that, out of reflected waves from the subreflector 2, enter the aperture of the primary radiator 3 is compared with the proportion, in cross section along the major-axis direction of the main reflector 1, of waves that, out of reflected waves from the subreflector 2, enter the aperture of the primary radiator 3, the former propotion is larger than the latter proportion; therefore the vertex matching plate 4 is defined as an ellipsoid, with its minor-axis direction oriented in the major-axis direction of the main reflector 1, and with its major-axis direction oriented in the major-axis direction of the main reflector 1. The major-minor axial ratio and the board thickness of the vertex matching plate 4 is set in such a manner that the waves that reenter the aperture of the primary radiator 3 after being reflected by the vertex matching plate 4, cancel out the waves that reenter the aperture of the primary radiator 3 after being reflected on the outside of the vertex matching plate 4. In a plural-reflector antenna system in which the perimeter of the main reflector 1 is made ellipsoidal, by setting the vertex matching plate 4 in this manner, the electric waves that reenter the primary radiator 3 are effectively cancelled out, and the deterioration of the VSWR in the primary radiator 3 can be suppressed.

Embodiment 2

Figure 3:
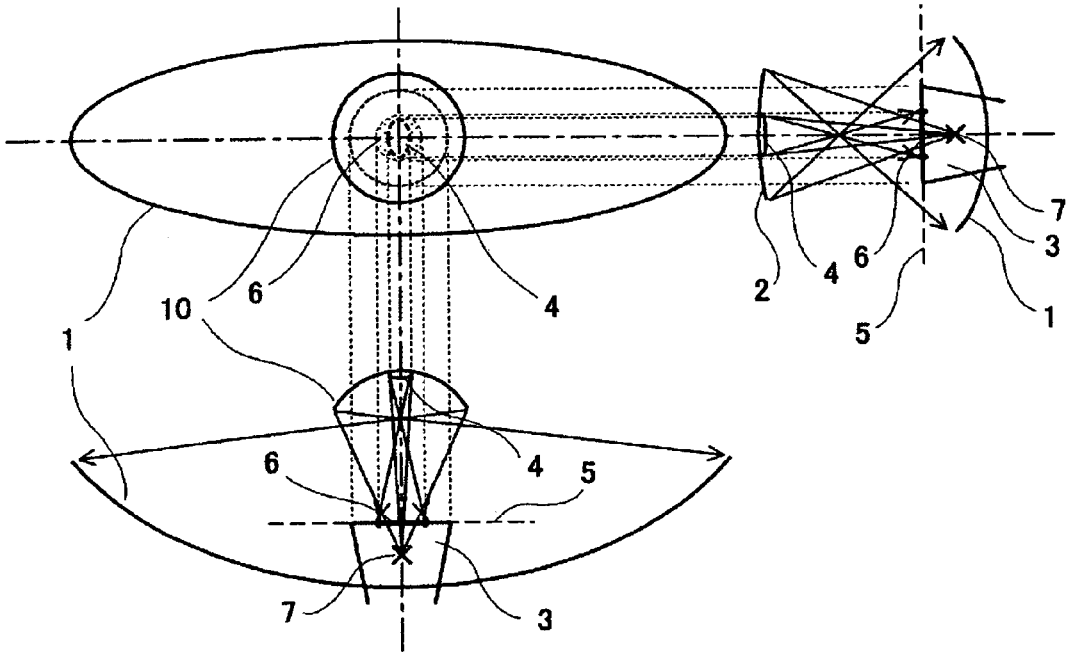
FIG. 3 is a view illustrating a configuration of a plural-reflector antenna system according to Embodiment 2 of the present invention.

FIG. 3 is a view illustrating a configuration of a plural-reflector antenna system according to Embodiment 2 of the present invention. In FIG. 3, at 10 is a subreflector that is concave as viewed from the primary radiator 3; a plural-reflector antenna system constituted of the main reflector 1, the subreflector 10, and the primary radiator 3 has the configuration of a Gregorian type antenna. In FIG. 3, components and parts indicated with the same reference marks as those in FIG. 1 are identical or equivalent to the components and parts in FIG. 1.

In the plural-reflector antenna system according to Embodiment 2, the focal position of the subreflector 10 is located between the main reflector 1 and the subreflector 10. The vertex matching plate 4 has an elliptical perimeter, as is the case with Embodiment 1, and is disposed in the approximately central position of the subreflector 10. By orienting the major-axis direction of the vertex matching plate 4 in the minor-axis direction of the main reflector 1 and the minor-axis direction of the vertex matching plate 4, in the major-axis direction of the main reflector 1, also in a Gregorian-type plural-reflector antenna system, the electric waves that reenter the primary radiator 3 are effectively cancelled out, and the deterioration of the VSWR in the primary radiator 3 can be suppressed.

Embodiment 3

Figure 4:
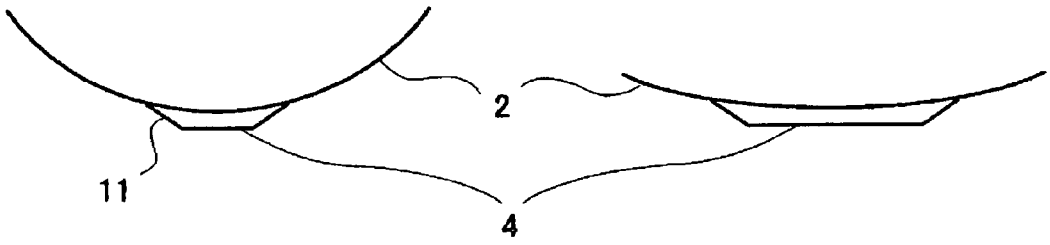
FIG. 4 is a view illustrating a configuration of a plural-reflector antenna system according to Embodiment 3 of the present invention.

FIG. 4 is a view illustrating a configuration of a plural-reflector antenna system according to Embodiment 3 of the present invention. In FIG. 4, at 11 is a skirt-shaped portion that is defined on the rim of the vertex matching plate 4. The vertex matching plate 4 illustrated in FIG. 4 can be applied in FIG. 1 or FIG. 3 corresponding to Embodiment 1 or Embodiment 2, respectively.

In FIG. 4, the level difference between the subreflector 2 and the vertex matching plate 4 is eliminated by forming the rim of the vertex matching plate 4 in skirt shape. Typically, the level difference on the subreflector 2 causes scattering of electric waves and increases side lobes in specific directions.

In Embodiment 3, by eliminating the level difference and the cause of the scattering by means of making the rim of the vertex matching plate 4 skirt-shaped, and by canceling out the electric waves that reenter the primary radiator 3, without inducing the deterioration in the radiation characteristics due to electric charges on the vertex matching plate 4, the deterioration of the VSWR in the primary radiator 3 can be suppressed.

Embodiment 4

Figure 5:
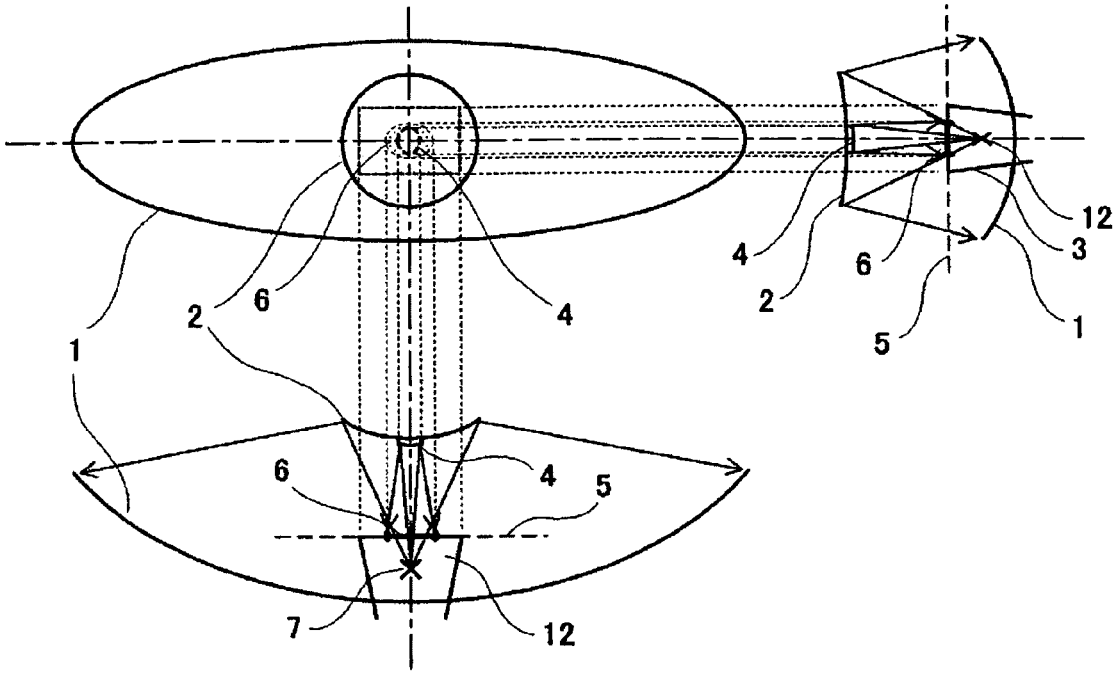
FIG. 5 is a view illustrating a configuration of a plural-reflector antenna system according to Embodiment 4 of the present invention.

FIG. 5 is a view illustrating a configuration of a plural-reflector antenna system according to Embodiment 4 of the present invention. In FIG. 5, at 12 is a primary radiator with a pyramidal horn. In FIG. 5, components and parts indicated with the same reference marks as those in FIG. 1 are identical or equivalent to the components and parts in FIG. 1.

In Embodiment 4, the horizontal-to-vertical ratio of the ellipsoid of the vertex matching plate 4 is set in such a manner that the passing area 6 in the horn aperture, through which the reflected waves from the vertex matching plate 4 pass, is made to be an ellipse that is analogous to the rectangular aperture shape of the pyramid horn of the primary radiator 12. Should the perimeter of the vertex matching plate 4 be a rectangular shape analogous to the aperture shape of the primary radiator 12, because wave-motion effect would make the passing area 6 in the horn aperture, through which the reflected waves from the vertex matching plate 4 pass, rounded-shape, and because the rectangular edges of the vertex matching plate 4 would be a cause of the scattering, the deterioration of the radiation characteristics would be induced.

To address this problem, the vertex matching plate 4 is made ellipsoid, and the horizontal-to-vertical ratio of the ellipsoid of the vertex matching plate 4 is set in such a manner that the passing area 6 in the horn aperture, through which the reflected waves from the vertex matching plate 4 pass, is made to be an ellipse whose shape is most analogous to that of the pyramid-horn rectangular aperture of the of the primary radiator 12. In FIG. 5, by setting the horizontal-to-vertical ratio of the ellipsoid of the vertex matching plate 4, the passing area 6 in the horn aperture, through which the reflected waves from the vertex matching plate 4 pass, is made elliptical; and, with respect to the rectangular-aperture shape of the pyramid horn of the primary radiator 12, the lengthwise direction of the rectangle is oriented in the major-axis direction of the passing area 6, and the crosswise direction of the rectangle, in the minor-axis direction of the passing area 6. Moreover, with regard to the primary radiator 12, the same effect can be obtained by utilizing an ellipsoidal (aperture) horn in place of the pyramidal horn.

Embodiment 5

Figure 6:
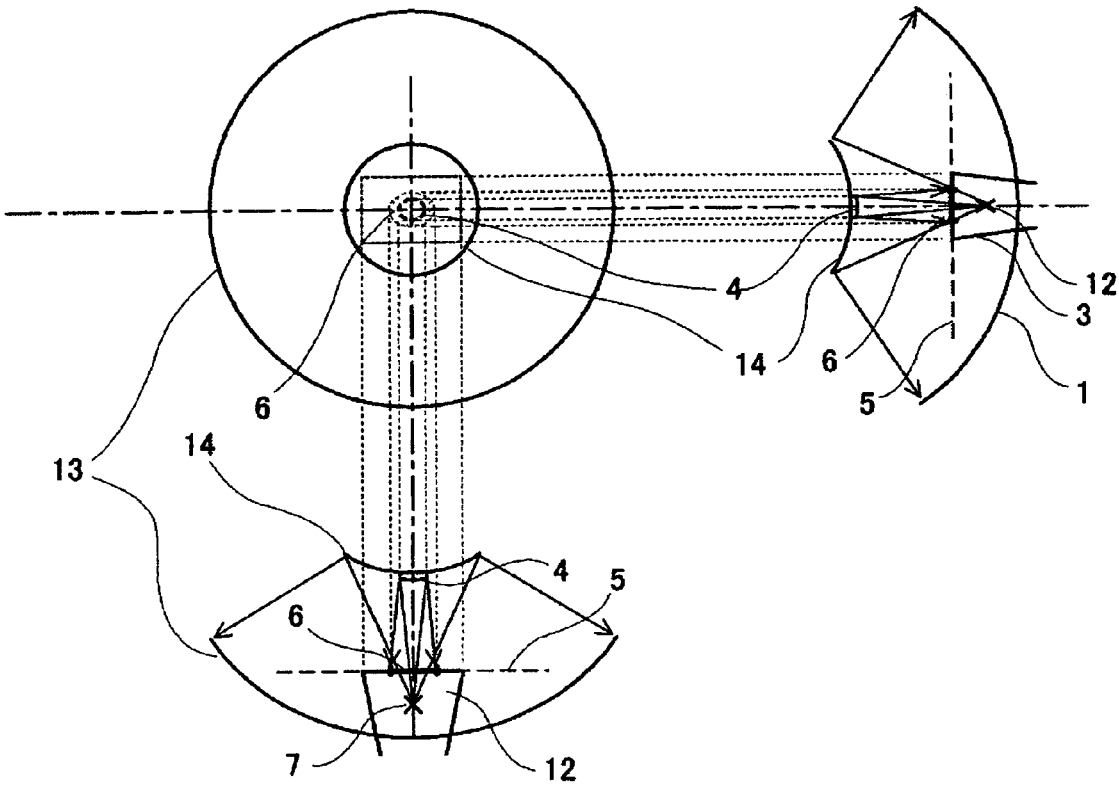
FIG. 6 is a view illustrating a configuration of a plural-reflector antenna system according to Embodiment 5 of the present invention.

FIG. 6 is a view illustrating a configuration of a plural-reflector antenna system according to Embodiment 5 of the present invention. In FIG. 6, at 13 is a main reflector that is axisymmetrically formed; the main reflector 13 has an approximately circular perimeter, and its mirror-surface contour is concave and aspheric (e.g., a paraboloidal or modified-paraboloidal mirror surface). At 14 is a subreflector that is axisymmetrically formed; the subreflector 14 has an approximately circular perimeter, and its mirror-surface contour is convex and aspheric (e.g., a hyperboloidal or modified-hyperboloidal mirror surface). In FIG. 6, components and parts indicated with the same reference marks as those in FIG. 5 are identical or equivalent to the components and parts in FIG. 5.

In Embodiment 5, the horizontal-to-vertical ratio of the ellipsoid of the vertex matching plate 4 is set in such a manner that the passing area 6 in the horn aperture, through which the reflected waves from the vertex matching plate 4 pass, is made to be an ellipse that is analogous to the rectangular aperture shape of the pyramid horn of the primary radiator 12. Although the main reflector 13 and the subreflector 14 are each axisymmetrical, the aperture of the primary radiator 12 is rectangular but not axisymmetrical. Even in this case, by appropriately setting the horizontal-to-vertical ratio of the ellipsoidal vertex matching plate 4, electric waves that reenter the pyramidal horn of the primary radiator 12 can be effectively cancelled out; therefore, the deterioration of the VSWR in the primary radiator 12 can be suppressed. Moreover, with regard to the primary radiator 12, the same effect can be obtained by utilizing an ellipsoidal (aperture) horn in place of the pyramidal horn.

Because this invention may be embodied in several forms without departing from the spirit of the essential characteristics thereof, the present embodiments are therefore illustrative and not restrictive, since the scope of the invention is defined by the appended claims rather than by the description preceding them, and all changes that fall within the metes and bounds of the claims, or the equivalence of such metes and bounds, are therefore intended to be embraced by the claims.

What is claimed is:

1. A plural-reflector antenna system comprising:

an ellipsoidal main reflector;

a subreflector being disposed opposite to the main reflector;

a primary radiator for radiating electric waves to the subreflector, the primary radiator being disposed opposite to the subreflector; and a vertex matching plate for reflecting to the primary radiator the electric waves radiated from the primary radiator, the vertex matching plate being disposed in the approximately central position of the subreflector and having an ellipsoidal mirror surface.

2. A plural-reflector antenna system according to claim 1, wherein the minor-axis direction of the ellipsoid of the vertex matching plate is oriented in the major-axis direction of the ellipsoid of the main reflector.

3. A plural-reflector antenna system according to claim 1, wherein the rim of the vertex matching plate is formed in a skirt shape.

4. A plural-reflector antenna system according to claim 1, wherein the primary radiator has a pyramidal horn.

5. A plural-reflector antenna system according to claim 1, wherein the primary radiator has an ellipsoidal horn.

6. A plural-reflector antenna system comprising:

an axisymmetrically-shaped main reflector;

a subreflector being disposed opposite to the main reflector;

a primary radiator for radiating electric waves to the subreflector, the primary radiator being disposed opposite to the subreflector and having a pyramidal horn; and a vertex matching plate for reflecting to the primary radiator the electric waves radiated from the primary radiator, the vertex matching plate being disposed in the approximately central position of the subreflector and having an ellipsoidal mirror surface.

7. A plural-reflector antenna system comprising:

an axisymmetrically-shaped main reflector;

a subreflector being disposed opposite to the main reflector;

a primary radiator for radiating electric waves to the subreflector, the primary radiator being disposed opposite to the subreflector and having an ellipsoidal horn; and a vertex matching plate for reflecting to the primary radiator the electric waves radiated from the primary radiator, the vertex matching plate being disposed in the approximately central position of the subreflector and having an ellipsoidal mirror surface.

* * * * *